United States Patent [19]

Vila

[11] 4,235,381

[45] Nov. 25, 1980

[54] DEVICES FOR COVERING OBJECTS WITH ELECTROSTATIC DUST

[76] Inventor: Juan R. Vila, Calle Santander, 29 A., Barcelona, Spain

[21] Appl. No.: 9,060

[22] Filed: Feb. 2, 1979

[30] Foreign Application Priority Data

Apr. 7, 1978 [ES] Spain ..... 468.633

[51] Int. Cl.[3] ..... B05B 5/04

[52] U.S. Cl. ..... 239/696; 239/698; 239/707

[58] Field of Search ..... 239/690, 696–698, 239/704–708

[56] References Cited

U.S. PATENT DOCUMENTS

| | | | |
|---|---|---|---|
| 3,210,008 | 10/1965 | Liedberg et al. | 239/707 |
| 3,296,015 | 1/1967 | Juvinall et al. | 239/705 X |
| 4,135,667 | 1/1979 | Benedek et al. | 239/697 |
| 4,169,560 | 10/1979 | Vöhringer | 239/698 |

*Primary Examiner*—Andres Kashnikow
*Attorney, Agent, or Firm*—Holman & Stern

[57] ABSTRACT

This invention is in an improvement in electrostatic spraying apparatus for coating objects with electrostatic powder, or dust. The apparatus includes a housing or body member having a discharge nozzle at one end and internal flow passages for conducting compressed gas supplied from an external source to the discharge nozzle and a deflector element coaxially disposed adjacent the discharge end of the nozzle. A source of powder or dust is provided and is mixed with the compressed gas to produce a powder gas mixture which is fed to the flow passage. Electrodes connected to a high voltage source are provided within the flow passage and at the discharge end of the nozzle to ionize the powder gas mixture. The invention provides a hollow oval shaped charging chamber within the nozzle communicating with the flow passage so that the powder gas mixture passes therethrough and is ionized therein. Auxiliary compressed gas is also passed to the nozzle and is ionized so that upon being discharged at the tip of the apparatus, it assists in augmenting the final charge of the powder which substantially improves the electrostatic application to the object being coated.

8 Claims, 8 Drawing Figures

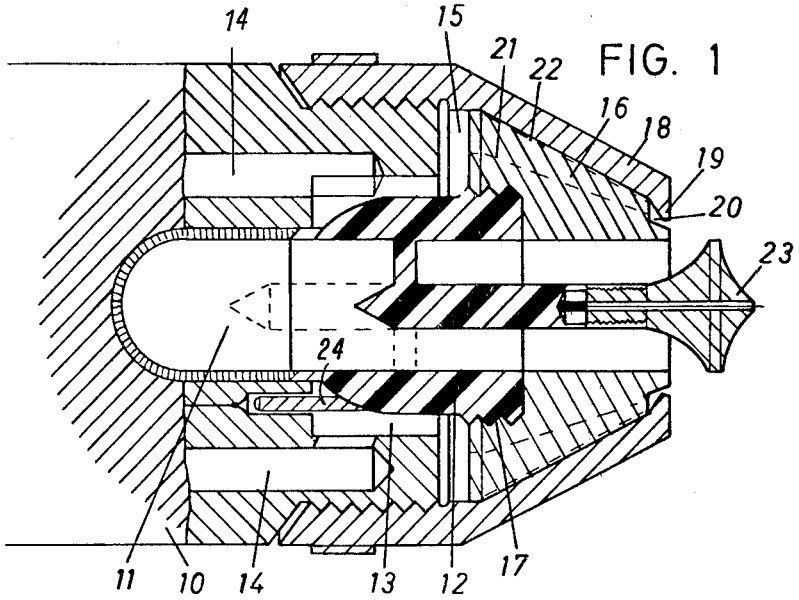
FIG. 1
FIG. 2
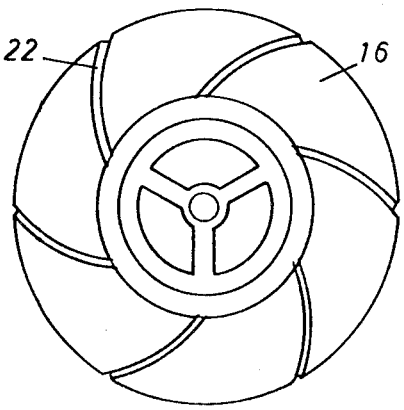
FIG. 3
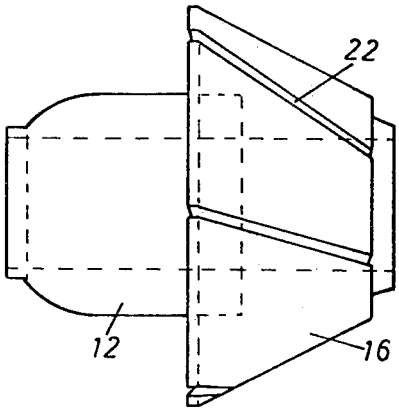
FIG. 4
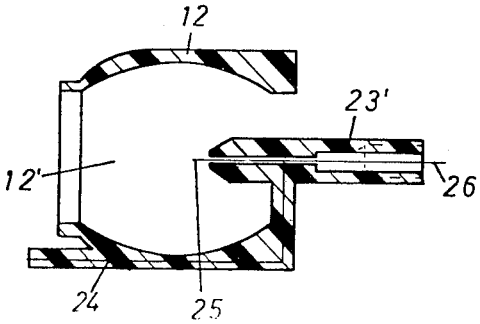

DEVICES FOR COVERING OBJECTS WITH ELECTROSTATIC DUST

BRIEF SUMMARY OF THE INVENTION

The present Invention refers to improvements in devices for covering objects with electrostatic dust, these improvements consisting in some special features considered to be new for the entire electrostatic dust applicator or spray gun which properties mean a new and beneficial effect that can be summed up in the following points:

Better application and longer lifespan of the assembly of parts constituting the spray gun, owing to its being formed by three independent assemblies that can be functionally coupled and interconnected.

A high safety operation of the device, despite highly flammable materials handled with it.

A perfect mix of the dust and covering spray with air, with a high density of the former and achieving a cloud of particles of very uniform density. The spray pattern and size are adjustable at will in a very simple way by operating a threaded adjusting element.

Reabsorbtion of the spray dust which looses part of its electrostatic dust.

Improved loading of the dust by reducing its muzzle speed, while a given part of the flow remains for a longer period under the electrostatic influence.

These last three points determine a very high electrostatic performance, with a dust adhesion rate percentage considerable higher than that achieved by other electrostatic spray devices used up till now, and consequently obtains a more even and thicker covering.

Aside from the particularities of the system or arrangement of charge electrodes for the dust, it has been experimentally determined that the adhesion efficiency is a result of the electrostatic properties of the dust used, of the pattern and density of the spray cloud, of its degree of adaptation to the three-dimensional geometry of the object being sprayed and of the desired thickness of the covering.

The improvements which are the object of this invention consist mainly on the substantial increase of the cloud density and on the uniformity of the dust-air mixture by means of creating a stream of ionized air added in the shape of a spiral cone to the spray area thus projecting the material to the area to be covered at a variable speed, always under control according to the requirements of each case.

In substance, these improvements are based on an entirely new design of the spraying device and of the pressurised air supply lines and their arrangement at the end of the insulated dust and air channel (pneumatic conveying). These features also make it possible to connect the spraying assembly and the additional air supply to conventional type spray guns, i.e., those having an independent high voltage generator, and, in general, to any similar device having the electrodes located either inside or outside the dust carrying line. The spray gun, besides being improved by the above features, is constituted by three independent assemblies: the spraying assembly, a centrally located high-voltage generator and a handle connected to it containing the controls and the complementary electronic components necessary for operating the generator. This configuration in three separate bodies enables the gun, in the event of failure of any of the parts, to continue in service after the easy replacement of the faulty assembly, while the other parts remain unchanged, thus affording important maintenance savings for the entire unit. Contrary to this, in all guns known up till now, all components constitute a single built-in whole, injected into insulating material and when some malfunction occurs in the generator or in the electronic components, the entire unit or gun must be replaced.

Another important feature of the described improvements, vital for obtaining the desired results and entirely new, is the previous ionization of a stream of pressurised air applied exteriorly to the air-carrying line in the spray area for the formation of the electrostatic dust cloud, efficiently helping in the achieving of a high density dust-air mix and consequently improving the electrostatic performance.

At the same time, owing to the special working characteristics of the device being described, it is fed through three separate lines: one line for the pneumatic supply of dust and air, another line for the supply to the spray area of pressurised air, previously ionized and shaping the flow into a spiral cone, and finally a low voltage lead to connect to the power source the electronic components and, chiefly, the high voltage generator. The improvements introduced in the spray gun include an insulating tube through which the dust is driven by the pressurised air from a pneumatic system, with a nozzle at its end, in contact with the high-voltage generator by means of a branch, so the inner flow chamber of said part is at the same potential as the generator, thus permitting the flowing dust to receive the correct charge. On the other hand, this chamber is designed in an oval shape, with a wider diameter in the middle, in the form of a revolving ellipse intersected at both ends by two circular planes, both of equal diameter which coincide respectively with feed and discharge openings of the chamber. This oval shape of the inner chamber of the nozzle, in contact with the high-voltage generator, slows down the dust speed and provides a more uniform distribution of the spray. The so described nozzle can be made also out of an insulating material, in which case, such part will be built with housings for the passage of one or more electrodes to the dust flow chamber so as to supply their electrostatic influence to the dust.

The outer surface of the contact nozzle is provided with a thread to receive a screw-on conical piece acting as a diffuser having its lateral surface grooved with preferably three to nine curved grooves or with channels inside its body with a pitch more pronounced than that defined by the generatrix lines of the whole. This diffusor has inside a double coaxial opening with a greater diameter near its base and with a thread in its inner wall to permit its screwing into the generator-connected nozzle and with an ample circular-section channel of the same diameter as the pressurised air-dust line.

Along the same axis as the nozzle, and fastened to the same by means of rigid ties, is a bushing made out of insulating material with an enclosed electrode which tips protude unto one side of the generator-connected chamber. In this way the dust fed to the chamber receives the electrostatic charge and at the same time, the dust that has lost part of its electrostatic charge is reabsorbed.

The assembly has a built-in voltage limiter and an automatic breaker, both of conventional type, to facilitate flammable materials to be handled by the proposed spray gun, regardless of the outside position of the electrodes.

When the contact nozzle is in insulating material, it must include a lead to connect the coaxial electrode in the deflector to the generator.

The base of the diffusor is slightly separated from the cylindrical surface existing at the end of the tubular section of the gun, with a reduced cross-section relative to the part containing the high-voltage generator. This area is threaded for the connection of a second cylindrical-conical hollow part atop the diffuser, constituting the connection with the centre part of the gun, a closed chamber between the diffuser and the cylindrical wall of the above-mentioned tubular end and highly precise adjustment between the conical surfaces of both elements with the generatrix of the second slightly more pitched than that of the other and thus, its narrower end remaining open, with its perimeter extended toward the inside by means of a small perimetral flange. The pressurised air tube is communicated with this chamber by means of a number of passages interconnected midway by a ring-shaped space surrounding the generator-connected nozzle. This area is under voltage and fluid passing through it becomes ionized.

The clearance between the second piece and the diffuser allows for ionized air under pressure to pass to the outside through the grooves of the latter, creating a draft that owing to the pitch of the grooves and/or passages causes the air to be blown to the outside in the form of a conical spiral. This clearance between the flange and the conical surface at the end of the diffuser is used to compensate for the distance existing between a given passage and the next, so helping to adequately shape the dispersion of the said conical spiral formed by the ionized air under pressure being shot out of the diffuser. The position of this flange can be varied by moving it along its longitudinal axis as a result of the more or less number of turns given to the cylindrical-conical piece on the gun body, this latter acting as a control to adjust the rate of flow of the air conical spiral by simply screwing in or out this piece and, therefore, modifying the dimensions of the dust and air cloud, each position of the adjustment corresponding to a different characteristic of the discharge chamber formed by the end of the diffuser and the barrier flange. The control is built in varied lengths and the passages in the diffuser can be designed so that the maximum rate of flow in the conical spiral may be achieved in some cases with the adjustment being either fully screwed in or out.

The electrostatic dust, after having gone through the ionizing chamber, hits the edge of the deflector, thus forming a radial distribution field of the particles with dimensions depending on the deflector diameter and its distance from the discharge opening, but in every case sufficient to carry the fluid to the area where the ionizing air under pressure, formed into a conical spiral, exerts its influence, this air stream entraining the dust and shaping a cloud of air and dust very evenly mixed, which provides a high electrostatic efficiency for the sprayed covering. Furthermore, the dust mixed with the pressurised air forms a cloud of uniform sized particles that are projected at an adjustable speed toward the surface to be treated, the speed depending on the intensity of the fluid stream supplied by the spraying device.

This spraying assembly, including the diffuser and the connected adjusting element, just described above, can be adapted to any type of electrostatic dust spraying gun and the drawings enclosed below illustrate in great detail an example of its application to a gun with external electrodes, both on one side of the dust and air discharge opening and on a point forward of the deflecting element.

BRIEF DESCRIPTION OF THE SEVERAL VIEWS OF THE DRAWINGS

FIG. 1 is a cross-sectional view of the tip of an electrostatic dust spraying gun showing the relationship of the parts according to the invention;

FIG. 2 is an elevational view of the front end of the diffuser element of FIG. 1;

FIG. 3 is a side elevation of the diffuser of FIG. 2;

FIG. 4 is a view in cross-section along the longitudinal axis of a modified nozzle member showing the shape of the internal chamber and the electrodes;

Figure 6:
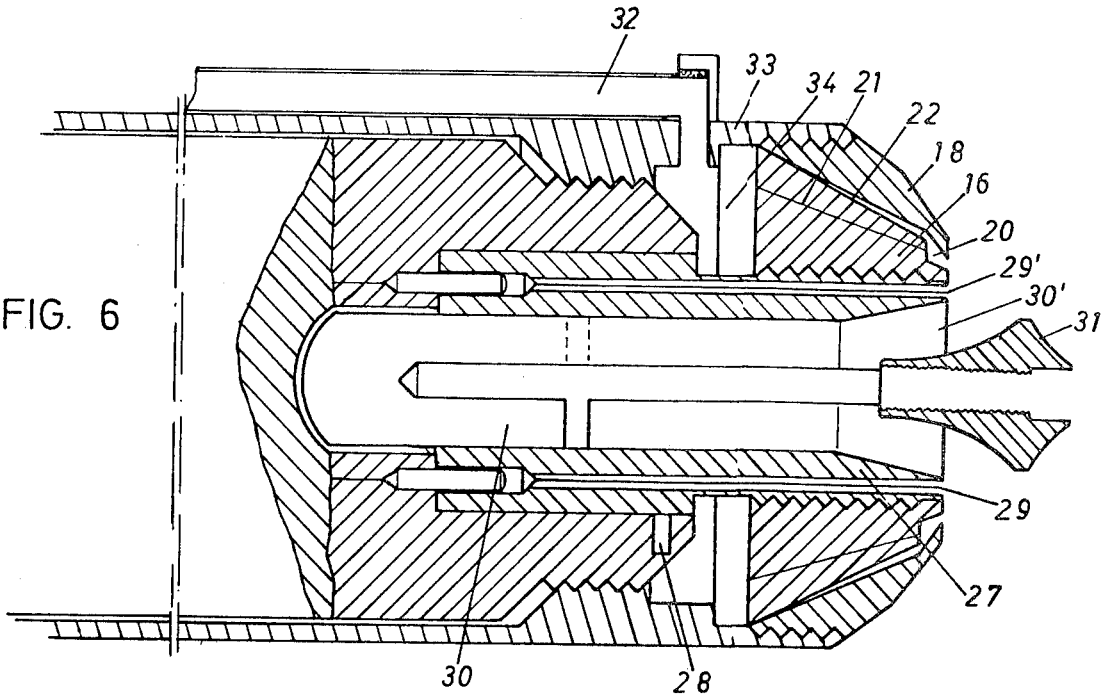
FIG. 6 shows the diffuser assembly according to the invention as adapted to an electrostatic dust spraying gun of the conventional type.

On the only plan sheet accompanying this report, FIG. 1, a longitudinal cross-section of an electrostatic dust spraying gun is shown, where 10 is the intermediate body; 11, the central dust-air flow passage; 12, the generator-connected nozzle; 13, the annular chamber around the nozzle (12); 14, air supply lines to the ionizing chamber (13) and 15, the space formed by the diffuser (16) and the threaded wall (17) at the end of the intermediate body (10). This same figure shows the adjustment element, 18, that is mounted coaxially on the diffuser by screwing it unto the body (10), which barrier flange (19) defines a space, 20, of variable volume, according to how far piece 18 has been screwed unto the body (10). Likewise, the broken lines indicate the passages, 21, or grooves, 22, in the diffuser body (16) and the deflector, 23, that can be screwed more or less to regulate the clearance between the deflector and the discharge opening of the dust-air passage (11).

FIG. 2 is the plan view of the diffuser (16) showing in full detail the grooves (22) cut in its surface, in a curved line, to make possible the creation of an ionized air stream in the shape of a conical spiral.

FIG. 3 is a side elevation of the diffuser (16) with grooves (22) cut in its surface and joined by a threaded connection to the end of the intermediate tubular body (10), precisely unto the generator-connected nozzle (12).

FIG. 4 shows in detail, in cross-section along the longitudinal axis, the possibility of constructing the nozzle (12) of insulating material, detailing the lead (24) connecting the electrodes, both internal, 25, and external, 26, to the chamber (12) and arranged coaxially relative to the cylindrical element, 23', holding the deflector (23).

Figure 5:
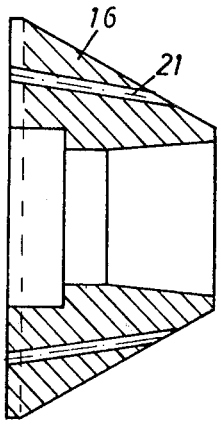
FIG. 5 is a view in cross-section of a modified diffuser element.

FIG. 5 represents, in longitudinal cross-section, the diffuser (16) showing the optional internal passages, 21, instead of surface grooves, 22, with a more pronounced pitch as proper for the generatrix lines of this conical piece (16). These passages perform the same function as the grooves (22). The same figure also shows the inner design of the diffuser consisting of a double cylindrical cavity.

FIG. 6 shows the way the diffuser assembly can be adapted to an electrostatic dust spraying gun of the usual type found in the market, causing it to form an air stream in the shape of a conical spiral at the end of the assembly, acting as a bed upon which the electrostatically charged dust glides along the insulated flow tube of the gun. This figure also shows electrode holder 27, fastened to the generator (not shown) by bolt 28; electrodes 29 and 29', protruding at a point very close to discharge opening, 30', of the central dust-air flow passage 30, the deflector 31, which causes the radial distribution of the dust and air mix coming from passage (30) and delivering it to the space dominated by the air stream shaped like a conical spiral, the air feed line (32), attached at the end of the gun by the threaded nipple (33) and the passage of said air current to the chamber 34 existing between the diffuser (16) and the gun wall, reduced at its extreme section. The adjusting element 18 modifies, as was shown in FIG. 1, the capacity of the chamber (20) and thus varies the dimensions of the electrostatic cloud shaped like a conical spiral by grooves (22) or passages (21) in the diffuser (16).

Figure 7:
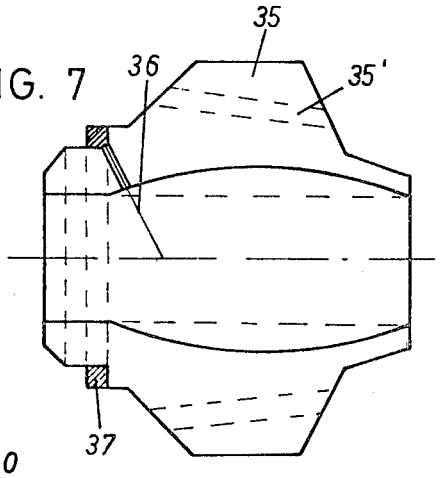
FIG. 7 show a side elevation of another modified diffuser element.

FIG. 7 shows a side elevation of another type of diffuser, 35, constructed of insulating material, where 36 is an electrode inserted through a passage opened inside the piece (35) to infuse electrostaticity to the dust-air mix, 37 is a ring making contact with the generator to ionize the air current added on the discharge orifice of the gun and 35' are passages or grooves where the fluid, by going through them, takes the conical-spiral pattern.

Figure 8:
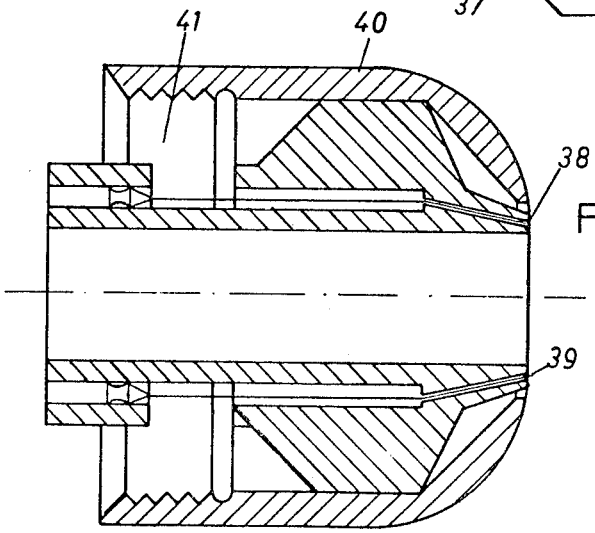
FIG. 8 is a view in cross-section of a spray gun of known type showing the modified diffuser of FIG. 7 and electrodes incorporated therein.

FIG. 8 is a gun of a known type, having incorporated the above-mentioned diffuser (35) and showing electrodes 38 and 39, the screw adjustment 40 and the ionization chamber 41, for the air added to the assembly.

I claim:

1. In an electrostatic spray coating apparatus for coating objects with electrostatic powder including a housing member, a discharge nozzle, an internal flow passage in said housing member for conducting compressed gas to the nozzle, a deflector coaxially disposed adjacent the discharge end of the nozzle, a source of compressed gas and a source of powder and means to produce a powder-gas mixture and feed it to the flow passage, means for ionizing the powder-gas mixture and a source of high voltage connected to the ionizing means, the improvement comprising a hollow charging chamber within the nozzle connected to the flow passage and through which the powder-gas mixture flows, said charging chamber having an oval shape with the long axis aligned with said flow passage, an electrode having an inner end extending into said chamber and the outer end disposed in the deflector at the discharge end of said nozzle, and means to provide an auxiliary flow of ionized gas to the discharge nozzle.

2. The apparatus as claimed in claim 1, wherein said deflector has a rod-like extension of conducting material projecting downstream within the flow passage into said charging chamber, said end projecting into said chamber being pointed and being said inner end of said electrode, said outer end of said electrode being disposed coaxially within and at the outer end of said deflector, said ionizing means comprising said chamber and electrode, said high voltage source being connected to said nozzle and said electrode.

3. The apparatus as claimed in claim 1, wherein said nozzle is comprised of an external tip member, a diffuser within said tip and a bushing of insulating material threadedly connected coaxially to the interior of said diffuser, said chamber being within said bushing, said ionizing means comprising said electrode and a second electrode within said chamber.

4. The apparatus as claimed in claim 1, wherein said nozzle is comprised of an external hollow coaxially shaped tip member, a diffuser within said tip having an outer conical surface and a bushing threadedly connected to the interior of said diffuser coaxially therewith, said chamber being within said bushing, said means to provide an auxiliary ionized gas comprising a plurality of spiral slots in the outer conical surface of the diffuser, annular flow channels surrounding said bushing and communicating with said slots, gas supply lines for supplying auxiliary compressed gas to said annular flow channels, said source of high voltage being connected to said bushing and said electrode, said auxiliary gas being ionized by passing over and in contact with said bushing.

5. The apparatus as claimed in claim 4, wherein said diffuser is adjustable to vary the flow of auxiliary gas.

6. The apparatus as claimed in claim 5, wherein said conical tip member is provided on its outer end with a radially extending flange to provide an annular chamber between said flange and the outer discharge end of said diffuser and to direct the flow of auxiliary gas in a coaxial spiral, said tip member being axially adjustable with respect to the central axis.

7. The apparatus as claimed in claim 6, wherein said tip member has a conical interior surface having a smaller apex angle than that of the conical surface on said diffuser.

8. In an electrostatic spray coating apparatus including a housing member, a discharge nozzle, an internal flow passage in said housing member for conducting compressed gas to said discharge nozzle, a deflector coaxially disposed adjacent the discharge end of the nozzle, a source of compressed gas and a source of powder material, means to produce a mixture of said gas and powder material and feed it to the flow passage, means to ionize the powder-gas mixture and a source of high voltage connected to the ionizing means, the improvement wherein said nozzle is comprised of an external hollow tip member and a diffuser made of insulating material having an outer peripheral surface engaging the inner surface of said tip member, an oval chamber within said diffuser, the long axis of said oval being coaxial with the central axis of the apparatus and through which the powder-gas mixture flows, said means for ionizing said mixture comprising at least one first electrode extending through said diffuser into said oval chamber and at least one second electrode extending through said diffuser and exposed to the powder-gas mixture at the discharge end of the nozzle, means to provide auxiliary ionized gas comprising, passageways through said diffuser, an annular outlet chamber between the outer surface of the diffuser and the inner surface of said tip member adjacent to the discharge end and communicating with said passageways, an annular orifice between the outer surface of the diffuser and the inner surface of the tip at the discharge end communicating with said outlet chamber, an annular ionization chamber between said tip member and said diffuser at the other downstream end thereof communicating with the downstream ends of said passageways remote from said discharge end, means to supply compressed auxiliary gas to said annular ionization chamber, said second electrodes passing through said annular ionization chamber to ionize the auxiliary gas passing therethrough, and said tip member being adjustable to vary the size of said annular orifice and outlet chamber.

* * * * *